US006455991B2

(12) United States Patent
Tsuji

(10) Patent No.: US 6,455,991 B2
(45) Date of Patent: Sep. 24, 2002

(54) CATHODE RAY TUBE WITH SHADOW MASK

(75) Inventor: Hiromichi Tsuji, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 80 days.

(21) Appl. No.: 09/761,505

(22) Filed: Jan. 16, 2001

(30) Foreign Application Priority Data

Jan. 17, 2000 (JP) ..... 2000-008088

(51) Int. Cl.[7] ..... H01J 29/80
(52) U.S. Cl. ..... 313/402; 313/403
(58) Field of Search ..... 313/402, 403

(56) References Cited

U.S. PATENT DOCUMENTS

| | | | |
|---|---|---|---|
| 5,534,746 | A | 7/1996 | Marks et al. |
| 5,583,391 | A | 12/1996 | Good et al. |
| 5,633,558 | A | 5/1997 | Watanabe et al. |
| 5,917,273 | A | 6/1999 | Watanabe et al. |

FOREIGN PATENT DOCUMENTS

| | | |
|---|---|---|
| FR | 2702881 | 9/1994 |
| JP | 57-090850 | 6/1982 |
| JP | 58-147941 | 9/1983 |

*Primary Examiner*—Vip Patel
(74) *Attorney, Agent, or Firm*—Merchant & Gould P.C.

(57) ABSTRACT

A cathode ray tube capable of reducing the shifting of apertures in the horizontal direction of the screen during the operation of the cathode ray tube, thereby preventing a color displacement, unevenness in colors, and reduction in luminance from occurring. By taking a center line of a shadow mask in a horizontal direction as an X-axis and a center line of the shadow mask in a vertical direction as a Y-axis, bridges in the vicinity of both ends of a perforated portion in the X-axis direction have a greater arrangement pitch in the vertical direction than that of bridges in the vicinity of a Y-axis. Accordingly, when a tension force is applied in the Y-axis direction to the shadow mask so that the shadow mask is stretched and held, a displacement of the aperture lines in the X-axis direction in the vicinity of both the ends of the shadow mask in the X-axis direction is suppressed to a small value, thereby reducing the shifting of the apertures in the X-axis direction during the operation of the cathode ray tube. This serves to prevent a color displacement, unevenness in colors, and reduction in luminance from occurring, and in addition, the occurrence of wrinkles in the shadow mask at the time when the shadow mask is stretched and held can be prevented.

6 Claims, 4 Drawing Sheets

CATHODE RAY TUBE WITH SHADOW MASK

BACKGROUND OF THE INVENTION

1. Field of the Invention

The present invention relates to a cathode ray tube having a shadow mask, which is used for a television receiver, a computer display, and the like.

2. Description of the Prior Art

FIG. 3 is a cross-sectional view illustrating an example of a conventional color cathode ray tube. The color cathode ray tube 1 shown in FIG. 3 includes a substantially rectangular-shaped face panel 2 having a phosphor screen 2*a* on its inner surface, a funnel 3 connected to the rear side of the face panel 2, an electron gun 4 contained in a neck portion 3*a* of the funnel 3, a shadow mask 6 facing the phosphor screen 2*a* inside the face panel 2, and a mask frame 7 for fixing the shadow mask 6. Furthermore, in order to deflect and scan electron beams, a deflection yoke 5 is provided on the outer periphery of the funnel 3.

The shadow mask 6 plays a role of selecting colors with respect to three electron beams emitted from the electron gun 4. "A" shows a track of the electron beams. The shadow mask has a flat plate provided with a number of substantially slot-shaped apertures formed by etching. The slot-shaped aperture is a through aperture through which electron beams pass.

In a color cathode ray tube, due to the thermal expansion caused by the impact of the emitted electron beams, the electron beam through aperture is shifted. Consequently, a doming phenomenon occurs. That is, the electron beams passing through the electron beam through apertures fail to hit a predetermined phosphor correctly, thus causing unevenness in colors. Therefore, a tension force to absorb the thermal expansion due to the temperature increase of the shadow mask is applied in advance, and then the shadow mask is stretched and held to the mask frame.

FIG. 4 is a perspective view illustrating an example of a conventional color-selecting electrode. A mask frame 10 is a rectangular frame and is made of a pair of long frame supports 11, facing each other, fixed to a pair of short frames made of elastic members 12. On a shadow mask 13, a number of substantially slot-shaped apertures 14 are formed as electron beam through apertures by etching and arranged in a number of lines. In this drawing, a tension method is employed and the shadow mask 13 is stretched and held between the supports 11 with a tension force applied mainly in the direction indicated by arrow Y.

When the shadow mask is stretched and held as mentioned above, even if the temperature of the shadow mask is raised, it is possible to reduce the amount of displacement between an aperture of the shadow mask and phosphor stripes of the phosphor screen.

However, the above-mentioned conventional color cathode ray tube suffers from the following problem. As shown in FIG. 4, the shadow mask 13 is stretched in the direction Y and fixed to the supports 11 in a state in which upper and lower ends of the shadow mask 13 are held. In this case, the shadow mask 13 that is stretched in the direction Y expands in the direction Y and also contracts in the direction indicated by arrow X that is perpendicular to the direction Y by an amount corresponding to the Poisson's ratio.

With respect to an aperture line 15, the shadow mask 13 is stretched in a state in which its upper and lower ends are held, so that the aperture line 15 expands in the direction Y, and at the same time, the aperture line is curved toward the center of the shadow mask 13 as indicated by the double-dashed line 15*a*.

When the color cathode ray tube is operated in this state, electron beams strike the surface of the shadow mask to reduce the tension force in the direction Y and also to reduce the compressive force in the direction X at the same time. As a result, the aperture line also returns to the outer (peripheral) direction. In other words, the problem with the conventional color cathode ray tube described above was that this shifting of the apertures due to the above-mentioned return movement caused a color displacement, unevenness in colors, and reduction in luminance.

SUMMARY OF THE INVENTION

It is an object of the present invention to solve the conventional problem described above by providing a cathode ray tube capable of reducing the shifting of apertures in the horizontal direction of the screen during the operation of the cathode ray tube, thereby preventing a color displacement, unevenness in colors, and reduction in luminance from occurring.

In order to achieve the above-mentioned object, a cathode ray tube according to the present invention includes a shadow mask made of a flat plate provided with a number of apertures and bridges for linking the apertures neighboring in the vertical direction, wherein, by taking a center line of the shadow mask in the horizontal direction as an X-axis and a center line of the shadow mask in the vertical direction as a Y-axis, the bridges in the vicinity of both ends in an X-axis direction of a portion where the apertures are formed have a vertical arrangement pitch that is greater than that of the bridges in the vicinity of the Y-axis. According to the cathode ray tube as described above, when a tension force is applied in the Y-axis direction to the shadow mask so that the shadow mask is stretched and held, a displacement in the X-axis direction of the aperture lines located in the vicinity of both the ends of the shadow mask in the X-axis direction can be suppressed to a small value. Therefore, the shifting of the apertures in the X-axis direction during the operation of the cathode ray tube can be reduced, thereby preventing a color displacement, unevenness in colors, and reduction in luminance from occurring and in addition, the occurrence of wrinkles in the shadow mask when the shadow mask is stretched and held also can be suppressed.

In the above-mentioned cathode ray tube, it is preferable that the arrangement pitch increases with approach to both the ends in the X-axis direction.

Furthermore, it is preferable that the arrangement pitch is substantially the same up to predetermined positions in the X-axis direction and increases with approach to both the ends in the X-axis direction from the predetermined positions.

Furthermore, it is preferable that the arrangement pitch is substantially the same up to predetermined positions in the X-axis direction and increases stepwise for every aperture line of a constant number with approach to both the ends in the X-axis direction from the predetermined positions.

Still further, it is preferable that the predetermined positions are located in the vicinity of both the ends of the X-axis direction.

These and other advantages of the present invention will become apparent to those skilled in the art upon reading and understanding the following detailed description with reference to the accompanying figures.

DESCRIPTION OF THE PREFERRED EMBODIMENTS

Figure 3:
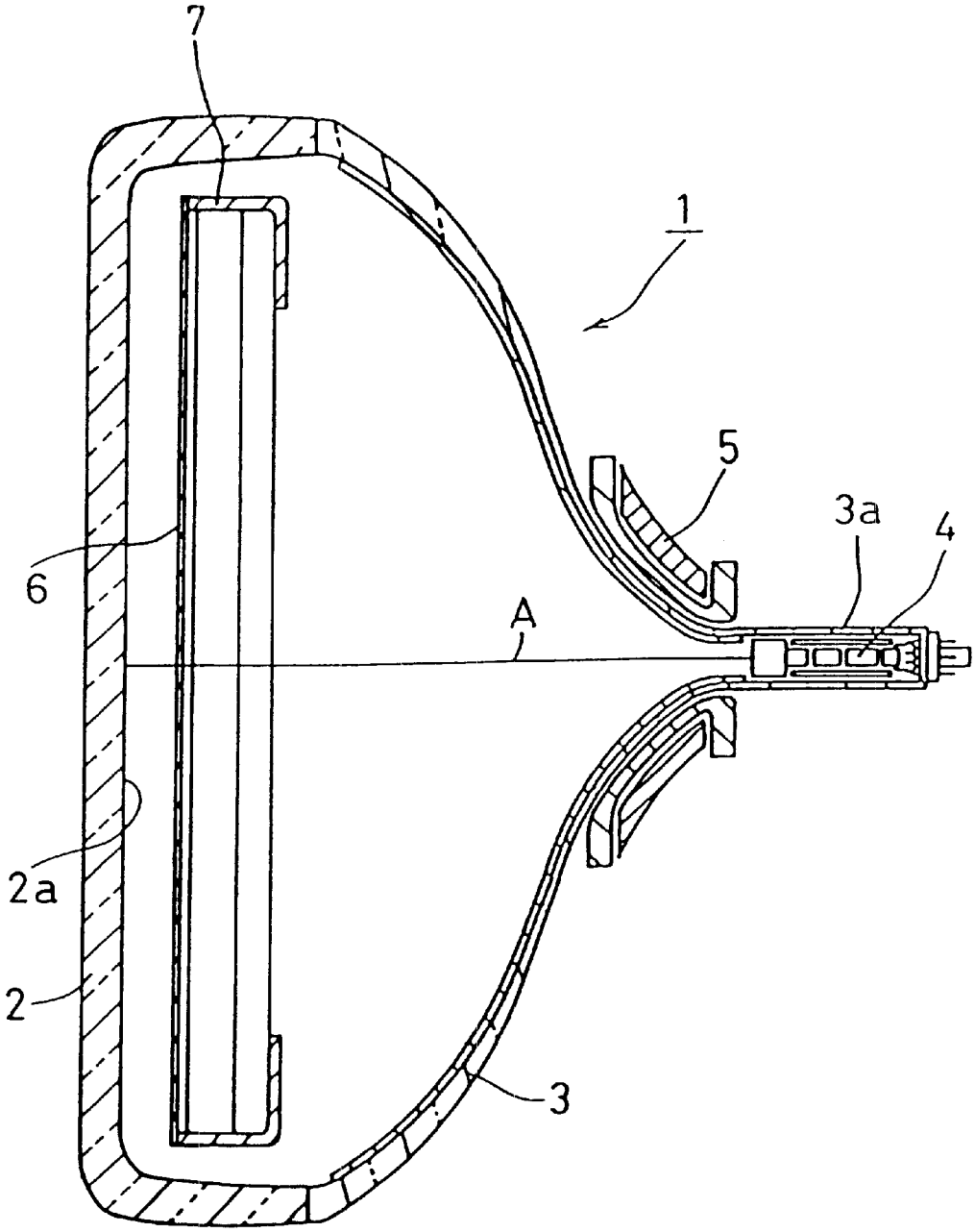
FIG. 3 PRIOR ART
FIG. 3 is a cross-sectional view showing an example of a conventional color cathode ray tube.
Figure 4:
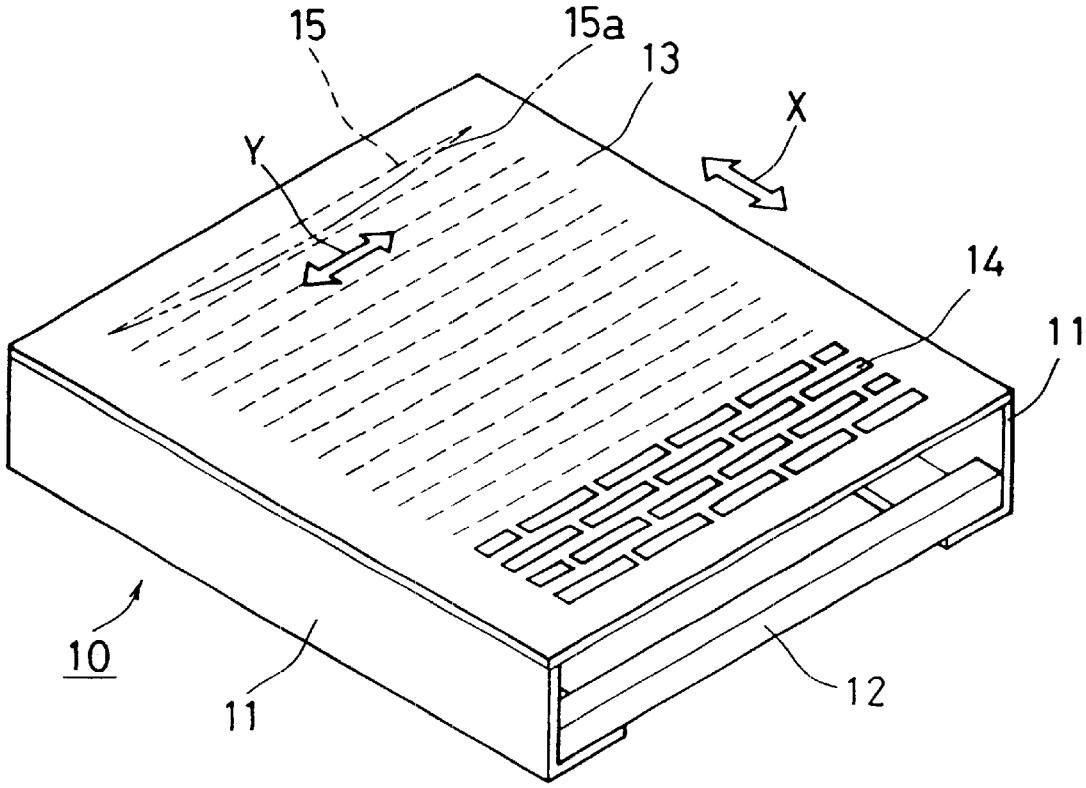
FIG. 4 PRIOR ART
FIG. 4 is a perspective view showing a color-selecting electrode according to a conventional embodiment.

Hereinafter, the present invention will be described by way of an embodiment with reference to the drawings. Since the construction of the color cathode ray tube described with reference to FIG. 3 is the same as that in the present embodiment, the explanations thereof are not repeated herein.

Figure 1:
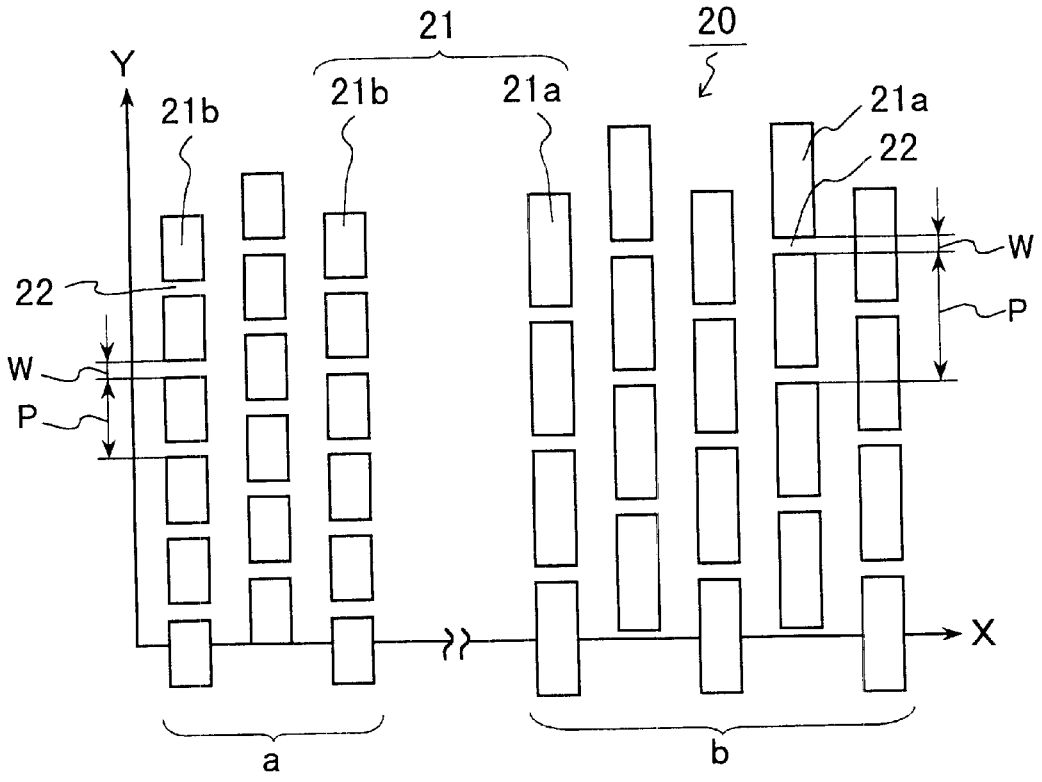
FIG. 1 is an enlarged view of a plan view showing a shadow mask according to the present embodiment.

FIG. 1 is an enlarged plan view showing a shadow mask according to the present embodiment. In a shadow mask 20 shown in this drawing, the Y-axis indicates the center line of the screen in the vertical direction and the X-axis indicates the center line of the screen in the horizontal direction. The shadow mask 20 has a number of substantially slot-shaped apertures 21 formed by etching, and the apertures 21 neighboring in the vertical direction are linked by a bridge 22. Apertures 21*b* in the area indicated by "a" are apertures located in the vicinity of the Y-axis, and apertures 21*a* in the area indicated by "b" are apertures located in the vicinity of the right end in the X-axis direction. The width W of the bridge 22 in the Y-axis direction is substantially the same over the entire shadow mask 20.

FIG. 1 schematically shows the arrangement of the apertures 21. Although only a part of the arrangement is illustrated in this drawing, the apertures 21 are arranged to be vertically symmetrical with respect to the vicinity of the X-axis and left-right symmetrical with respect to the vicinity of the Y-axis. "P" indicates a vertical pitch of the bridges 22. The pitch P in the vicinity of the X-axis (i.e. the area indicated by "b") is greater than the pitch P in the vicinity of both ends of the shadow mask in the Y-axis direction (i.e. the area indicated by "a"). Accordingly, the apertures 21*a* are formed longer in the Y-axis direction than the apertures 21*b*.

Figure 2A:
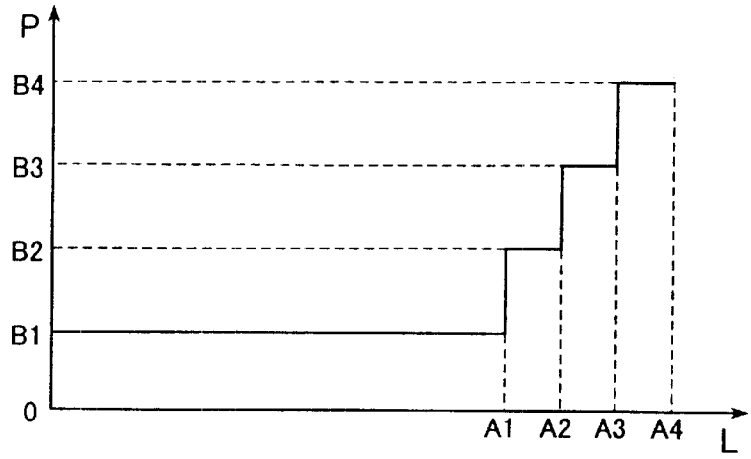
FIGS. 2A, 2B, and 2C are graphs showing the relationship between the distance L from the Y-axis and the pitch P in the present embodiment.
Figure 2B:
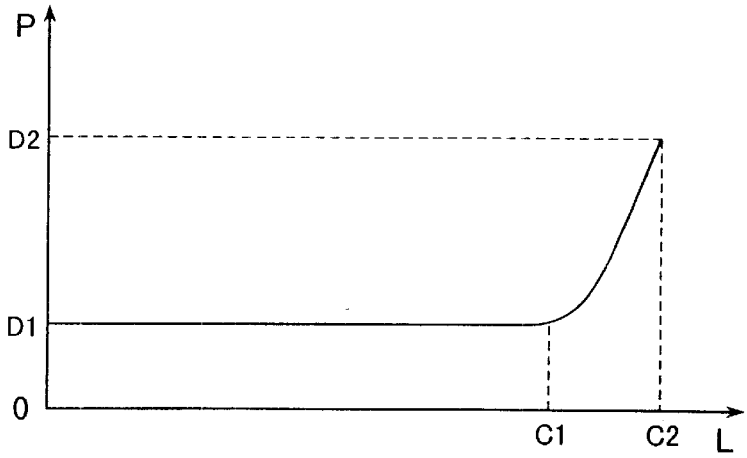
Figure 2C:
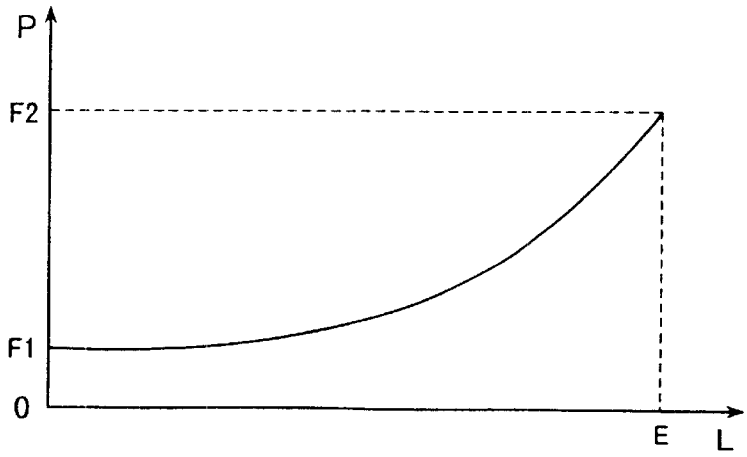

FIGS. 2A to 2C are graphs showing the relationship between the distance L from the Y-axis and the pitch P. Each graph shows the condition on the right side from the Y-axis by seeing the shadow mask from the side of the phosphor screen. Although the condition on the left side from the Y-axis is abbreviated in these drawings, it is symmetrical with respect to the Y-axis for the condition shown in each graph. "A4", "C2", and "E" in these graphs indicate the rightmost portion of the perforated portion of the shadow mask 20.

In the embodiment illustrated in FIG. 2A, the pitch P has a constant value B1 up to L=A1. However, in the portion where L is more than A1, the pitch P is increased stepwise for every aperture line of a constant number. Specifically, P=B2 when the distance L is between A1 and A2, P=B3 when the distance L is between A2 and A3, and P=B4 when the distance L is between A3 and A4. As described above, it is sufficient to form the area in which the pitch P is increased stepwise at least in the vicinity of both ends in the X-axis direction of the perforated portion of the shadow mask. For example, the distance between A1 and A4 is 10% of the total length of the perforated portion of the shadow mask in the Y-axis direction.

In the embodiment illustrated in FIG. 2B, the pitch P has a constant value D1 up to C1. However, in the portion where L is more than C1, the pitch P is increased gradually as the distance L is increased. Specifically, P=D1 when the distance L is C1 and P=D2 when the distance L is C2.

As in the embodiment illustrated in FIG. 2A, it is sufficient to form the area in which the pitch P is increasing gradually at least in the vicinity of both ends of the perforated portion of the shadow mask. For example, the distance between C1 and C2 is 10% of the total length of the perforated portion of the shadow mask in the Y-axis direction.

In the embodiment illustrated in FIG. 2C, the pitch P is increased gradually from F1 to F2 in the area between the Y-axis and the right end where L=E. In the embodiments illustrated in FIGS. 2A to 2C, the pitch P has, for example, a minimum value of 0.56 mm and a maximum value of 8 mm.

With regard to the shadow mask that is stretched and held, when a tension force is applied in the Y-axis direction, the shadow mask as a whole expands in the Y-axis direction and also contracts in the X-axis direction by the amount corresponding to the Poisson's ratio. Since the tension force is applied in the Y-axis direction in a state in which upper and lower ends of the shadow mask are fixed, when the pitch of the bridge is approximately the same over the entire shadow mask, the contraction of the shadow mask in the X-axis direction is reduced at the upper and lower ends of the shadow mask, while the contraction is increased toward the X-axis. Furthermore, with regard to the X-axis direction, the contraction is reduced in the vicinity of the Y-axis and increased toward both the ends in the X-axis direction.

In the present embodiment, as illustrated in FIGS. 2A to 2C, the pitch P of the bridge in the vicinity of both the ends in the X-axis direction is greater than the pitch P of the bridges in the vicinity of the Y-axis. That is, when it is compared between the aperture lines, the aperture lines located in the vicinity of both the ends in the X-axis direction have a smaller number of bridges and apertures that are longer in the Y-axis direction, compared with the aperture lines located in the vicinity of the Y-axis.

Accordingly, when a tension force is applied in the Y-axis direction, a force applied in the X-axis direction to the aperture lines in the vicinity of both the ends in the X-axis direction is reduced as compared with the case where the pitch of the bridge is reduced to a pitch that is as narrow as the pitch of the bridge in the vicinity of the Y-axis. In other words, in the present embodiment, when it is compared with the case where the pitch of the bridge is substantially the same over the entire shadow mask, the displacement approaching the Y-axis can be suppressed to a small value for the aperture lines located in the vicinity of both the ends in the X-axis direction.

If the color cathode ray tube thus stretched and held is operated, electron beams strike the surface of the shadow mask to reduce the tension force in the Y-axis direction due to the temperature increase and also to reduce a compressive force in the X-axis direction at the same time. In the present embodiment mentioned above, since the displacement of the aperture lines is suppressed at the time when the shadow mask is stretched and held, the movement change of the aperture lines due to the reduction of the compressive force in the X-axis direction is reduced.

Therefore, according to the present embodiment, as the movement change of the aperture lines due to the above-mentioned return movement at both the end portions in the X-axis direction during the operation of the color cathode ray tube can be suppressed, a color displacement, unevenness in colors, and reduction in luminance can be prevented. In addition, as the pitch of the bridge is increased in both the end portions in the X-axis direction, the vertical length of the apertures in this portion also is increased. This also serves to prevent reduction in luminance in the periphery of the screen.

Furthermore, in the present embodiment, the pitch of the bridge is not increased over the entire shadow mask. Thus, a mechanical strength of the shadow mask as a whole can be ensured, while a color displacement, unevenness in colors, and reduction in luminance can be prevented.

Moreover, when the shadow mask is stretched and held, if the contraction in the X-axis direction increases, wrinkles are liable to occur in the shadow mask. However, in the present embodiment, as the displacement of the aperture lines in the X-axis direction during such stretching and holding is suppressed as mentioned above, the occurrence of wrinkles also can be prevented.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a shadow mask made of a flat plate provided with a number of apertures and bridges for linking the apertures neighboring in the vertical direction, wherein, by taking a center line of the shadow mask in a horizontal direction as an X-axis and a center line of the shadow mask in a vertical direction as a Y-axis, the bridges in a vicinity of both ends in an X-axis direction of a portion where the apertures are formed have a vertical arrangement pitch that is greater than that of the bridges in a vicinity of the Y-axis.

2. The cathode ray tube according to claim 1, wherein the arrangement pitch increases with approach to both the ends in the X-axis direction.

3. The cathode ray tube according to claim 1, wherein the arrangement pitch is substantially the same up to predetermined positions in the X-axis direction and increases with approach to both the ends in the X-axis direction from the predetermined positions.

4. The cathode ray tube according to claim 3, wherein the predetermined positions are located in the vicinity of both the ends of the X-axis direction.

5. The cathode ray tube according to claim 1, wherein the arrangement pitch is substantially the same up to predetermined positions in the X-axis direction and increases stepwise for every aperture line of a constant number with approach to both the ends in the X-axis direction from the predetermined positions.

6. The cathode ray tube according to claim 5, wherein the predetermined positions are located in the vicinity of both the ends of the X-axis direction.

* * * * *